United States Patent [19]

Roquet Jorda

[11] 4,434,705

[45] Mar. 6, 1984

[54] INTRODUCED IN THE HYDRAULIC ACTUATION FOR THE ALTERNATIVE MOVEMENTS OF THE SWINGING ARMS OF PETROLEUM EXTRACTOR MACHINES

[76] Inventor: Pedro Roquet Jorda, Antonio Figueras, St. No. 83, Tona (Barcelona), Spain

[21] Appl. No.: 315,590

[22] Filed: Oct. 30, 1981

Related U.S. Application Data

[63] Continuation of Ser. No. 91,856, Nov. 6, 1979, abandoned.

[51] Int. Cl.[3] ..... F01L 25/06

[52] U.S. Cl. ..... 91/50; 91/210; 91/307; 91/309

[58] Field of Search ..... 91/50, 216 B, 196, 304, 91/307, 309, 210; 60/372; 74/589

[56] References Cited

U.S. PATENT DOCUMENTS

| | | | |
|---|---|---|---|
| 2,477,359 | 7/1949 | Barksdale | 91/50 |
| 2,729,941 | 1/1956 | Rose et al. | 91/50 |
| 2,914,036 | 11/1959 | Johnson | 91/50 |
| 3,971,213 | 7/1976 | Kelly | 91/30 X |

FOREIGN PATENT DOCUMENTS

| | | | |
|---|---|---|---|
| 839859 | 6/1960 | United Kingdom | 91/30 X |

*Primary Examiner*—Paul E. Maslousky
*Attorney, Agent, or Firm*—William A. Drucker

[57] ABSTRACT

A reciprocable drive mechanism has a fluid pressure operable ram controlled by a spool valve, a two-position valve and a braking valve. During a powered stroke of the ram, the spool valve closes an exhaust path of the two-position valve so that the latter remains in a first position in which pressure fluid is obliged to flow through the braking valve, in a fully opened condition, to the cylinder of the ram. At the end of the powered stroke the spool valve is shifted to a second position in which it permits exhausting of fluid through the two-position valve, and as a result of change of differential pressure in the latter, the pressure fluid previously obliged to flow through the braking valve is permitted to flow to exhaust. The braking valve is then less open, so the ram carries out its return stroke at a slower rate.

1 Claim, 5 Drawing Figures

INTRODUCED IN THE HYDRAULIC ACTUATION FOR THE ALTERNATIVE MOVEMENTS OF THE SWINGING ARMS OF PETROLEUM EXTRACTOR MACHINES

This is a continuation of Ser. No. 91,856 filed Nov. 6, 1979, now abandoned.

The main object of the invention is to provide improvements in a reciprocating hydraulic drive mechanism suitable for example for driving the swinging arm of an oil well pump.

Other objects are to provide a drive mechanism which has the possibility of a very smooth and adjustable movement reversal, and the possibility to obtain several speeds in both directions, and the possibility of adjusting the stroke of an actuating hydraulic ram.

SUMMARY OF THE INVENTION

According to the present invention a single-stroke hydraulically powered reciprocating drive mechanism comprises a source of fluid under pressure, a hydraulic ram including a cylinder and a piston reciprocable in the cylinder and defining therein a chamber of variable volume, a spool valve having first and second positions, a valve striker means moving with the hydraulic ram and changing the spool valve from one position to another at each end of the stroke of the hydraulic ram, a resiliently-loaded two-way valve having an inlet connected in a first position to a first outlet, said valve being arranged upon decrease of back pressure in the first outlet to move to a second position in which the inlet is also connected to a second outlet, a resiliently-loaded braking valve having conditions of lesser and greater opening, first conduit means connecting the source of fluid under pressure to the inlet of the two-way valve and to said braking valve, second conduit means connecting the second outlet of said two-way valve and said spool valve to exhaust to said source of fluid under pressure, third conduit means connecting said braking valve to said chamber of variable volume, and fourth conduit means connecting the first outlet of said two-way valve to said spool valve, the arrangement being such that in said first position of said spool valve corresponding to a powered stroke of said hydraulic ram the spool valve closes the fourth conduit means and the resultant higher differential pressure maintains the two-way valve in its first position so that fluid under pressure in the first conduit means maintains the braking valve in its condition of greater opening so that fluid passes through the third conduit means to the chamber of variable volume to actuate the ram, whereas at the end of the powered stroke the spool valve is moved to its second position in which it provides a communication between the fourth and second conduit means and as a result the differential pressure reduces and permits the two-way valve to move to its second position to connect the first and second conduit means, thereby permitting exhausting of fluid from said chamber of variable volume through said third conduit means, said braking valve in its condition of lesser opening, and said first and second conduit means.

BRIEF DESCRIPTION OF THE DRAWINGS

An embodiment of drive mechanism is shown in the drawings, wherein.

DESCRIPTION OF THE PREFERRED EMBODIMENT

Figure 1:
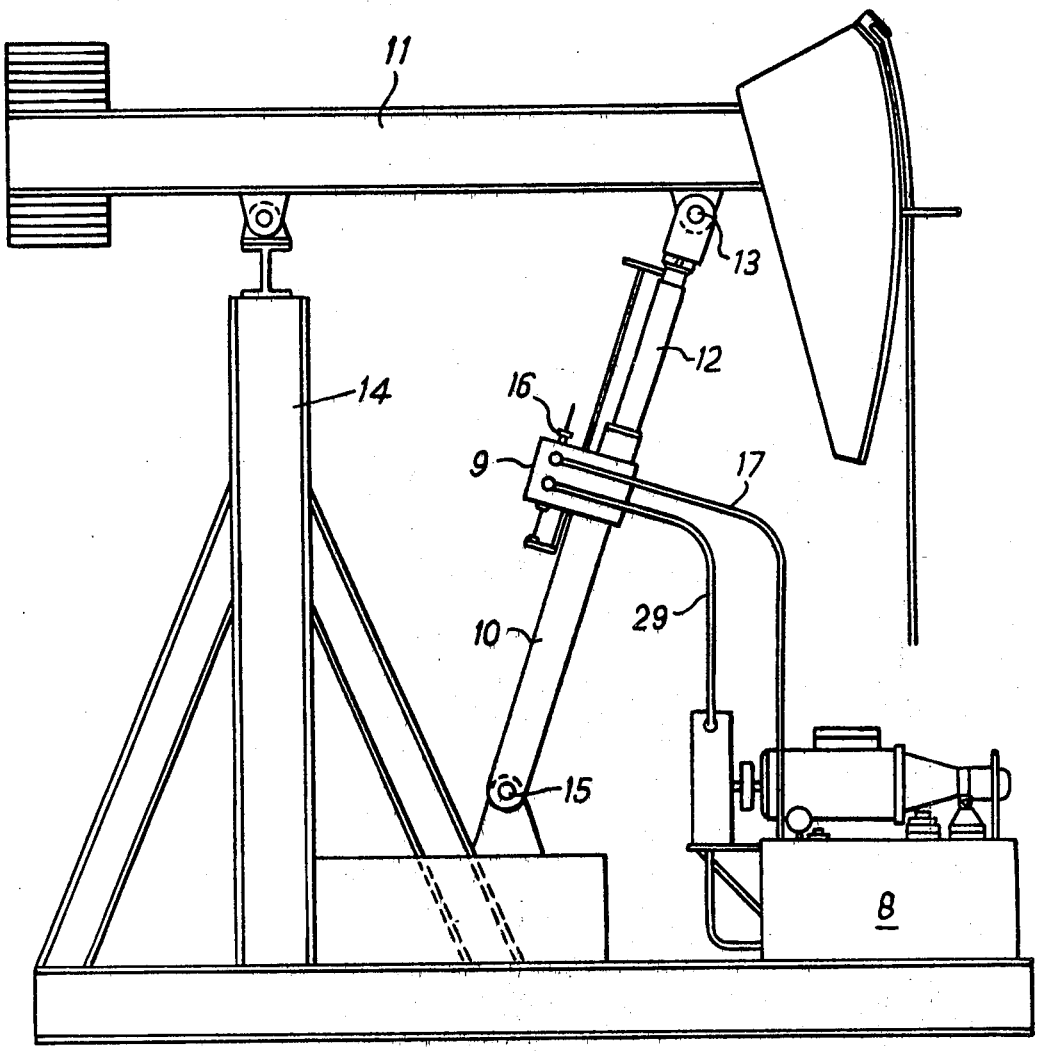
FIG. 1 shows an elevation of a hydraulic drive mechanism applied to an oil well pump.
Figure 2:
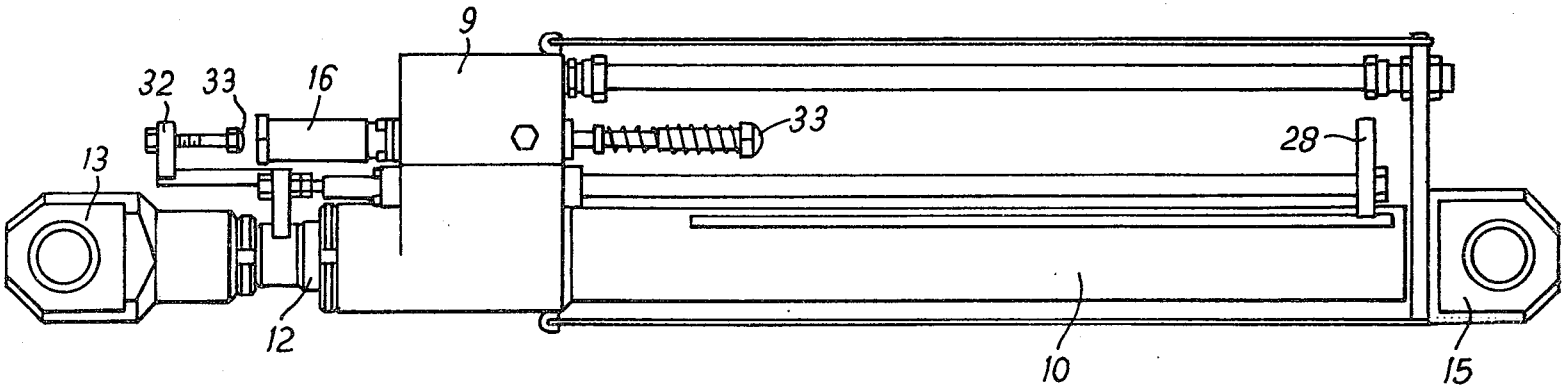
FIG. 2 is a side elevation of the hydraulic mechanism.
Figure 3:
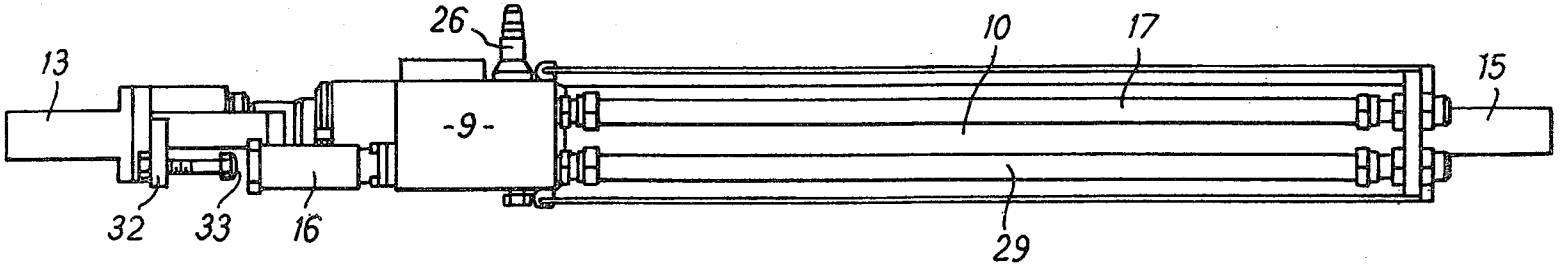
FIG. 3 is a plan view of the hydraulic mechanism.
Figure 4:
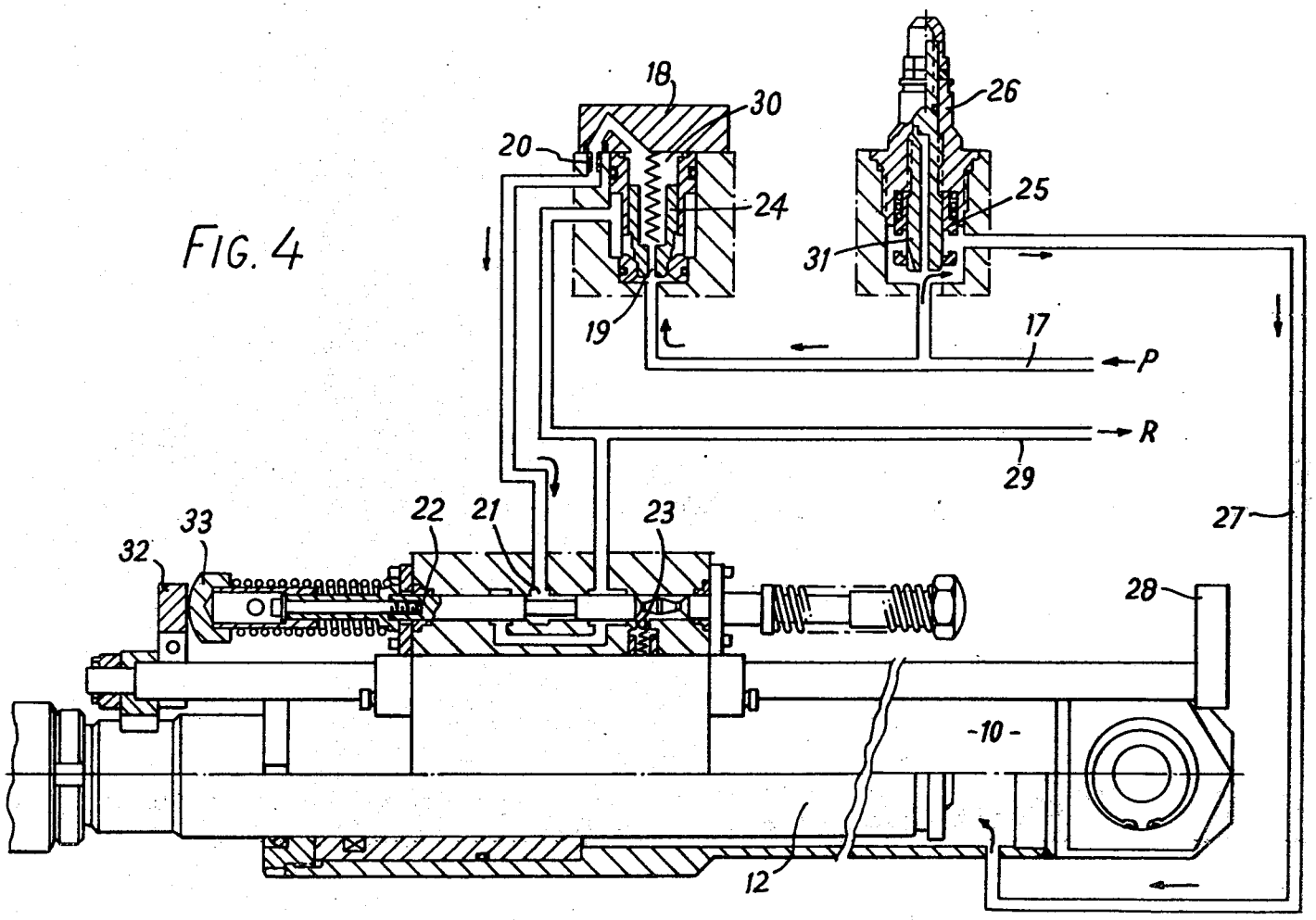
FIG. 4 is a hydraulic circuit showing the components of the mechanism in a lifting stroke condition.

A source of hydraulic fluid under pressure, in the form of a power pack 8, is connected to a valve assembly 9 of a hydraulic ram 10, the purpose of which is to transform the pressure energy created in the power pack 8 into an alternating movement that will be transmitted to a swinging arm 11 of an oil well pump, the arm 11 being connected to a piston rod 12 of the ram by means of a coupling 13. The swinging arm 11 is pivotally mounted on a support 14 having a base pivotal coupling 15 for the cylinder of the hydraulic ram.

The valve assembly 9 has the function of controlling, by means of appropriate valves, the flow of hydraulic fluid in the necessary directions, and is provided with a reciprocable valve actuating means 16.

The hydraulic fluid under pressure, from the power pack 8, passes through a first conduit 17 at "P" and reaches a resiliently-loaded two-way, i.e. two-position, valve 18 through a port 19 and then passes through a first outlet 20 to a fourth conduit and thence to a closed chamber 21 in which there is a reversal spool valve element 22 movably located by a spring-loaded ball detent 23.

Valve element 24 is kept closed by differential pressure and consequently the pressure obliges a check valve element 25 of a braking valve 26 to move from its seat and allow fluid to pass through a third conduit 27 towards the chamber of the actuating ram 10, thereby pushing the piston rod 12 and causing the lifting of the swinging arm 11.

Figure 5:
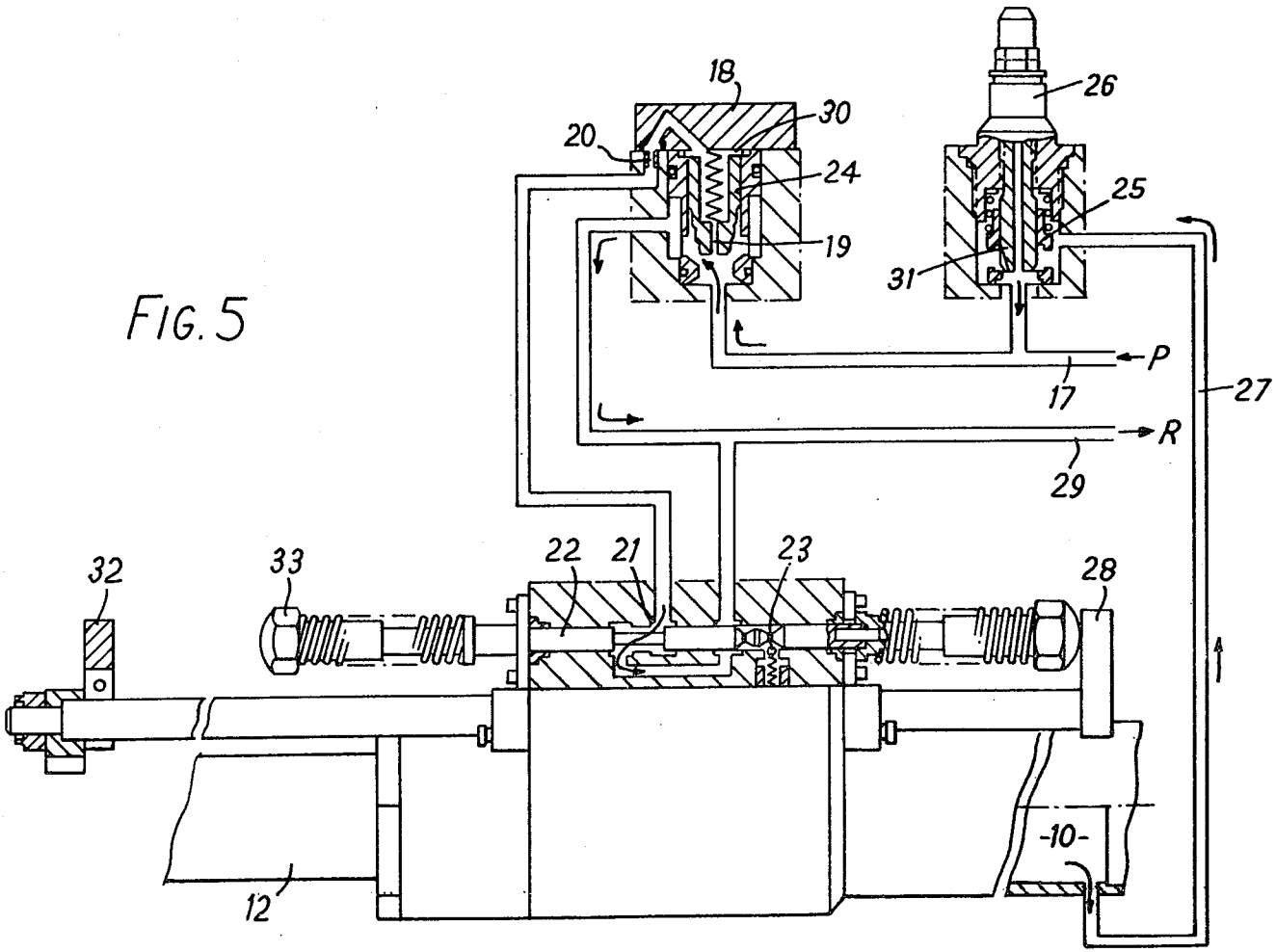
FIG. 5 is a hydraulic circuit showing the components of the mechanism in a lowering stroke condition.

When the piston rod reaches a predetermined position of lifting, a stop 28 moves the reversal spool element 22, changing its position to that shown in FIG. 5. Movement reversal can be adjusted in stepless manner, thereby delaying the opening and closing times of the valve element 24.

After reversal, the closed chamber 21 is connected with a second conduit 29, and a hydraulic unbalance is produced in the chamber 30, created by the different dimensions of port 19 and outlet 20. For this reason, valve element 24 is opened, and the first conduit is connected with the second conduit leading to the return to the power source. The ram piston immediately stops its lifting movement, and a return movement is begun due to gravity acting on the swinging arm 11.

To avoid acceleration during the descent, a valve element 31 is provided in the braking valve housing 26 and is adjustable to the load. When a predetermined lowered position is reached, the stop 32 again actuates the reversal spool element 22 by means of its part 33, and the cycle starts again.

I claim:

1. A single-stroke hydraulically-powered reciprocating drive mechanism comprising:

(i) a source of fluid under pressure (ii) a hydraulic ram including a cylinder, and a piston reciprocable in the cylinder and defining therein a a chamber of variable volume, (iii) a spool valve having first and second positions (iv) valve striker means moving with the hydraulic ram and changing the spool valve from one position to another at each end of the stroke of the hydraulic ram, (v) a resiliently-loaded two-way valve having an inlet connected in a first position to a first outlet, said valve being arranged upon decrease of back pressure in the first outlet to move to a second position in which the inlet is also connected to a second outlet, (vi) a resiliently-loaded braking valve having conditions of lesser and greater opening, (vii) first conduit means connecting the source of fluid under pressure to the inlet of said two-way valve and to said braking valve, (viii) second conduit means connecting the second outlet of said two-way valve and said spool valve to exhaust to said source of fluid under pressure, (ix) third conduit means connecting said braking valve to said chamber of variable volume, and (x) fourth conduit means connecting the first outlet of said two-way valve to said spool valve, the arrangement being such that in said first position of said spool valve corresponding to a powered stroke of said hydraulic ram, the spool valve closes the fourth conduit means and the resultant higher differential pressure maintains the two-way valve in its first position so that fluid under pressure in the first conduit means maintains the braking valve in its condition of greater opening so that fluid passes through the third conduit to the chamber of variable volume to actuate the ram, whereas at the end of the powered stroke the spool valve is moved to its second position in which it provides a communication between the fourth and second conduit means and as a result the differential pressure reduces and permits the two-way valve to move to its second position to connect the first and second conduit means, thereby permitting exhausting of fluid from said chamber of variable volume through said third conduit means, said braking valve in its condition of lesser opening, and said first and second conduit means.

* * * * *